US012208981B2

(12) United States Patent
Kazama

(10) Patent No.: US 12,208,981 B2
(45) Date of Patent: Jan. 28, 2025

(54) SHEET STACKER AND IMAGE FORMING APPARATUS INCORPORATING SAME

(71) Applicant: Ikumi Kazama, Kanagawa (JP)

(72) Inventor: Ikumi Kazama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 107 days.

(21) Appl. No.: 17/937,837

(22) Filed: Oct. 4, 2022

(65) Prior Publication Data

US 2023/0127575 A1 Apr. 27, 2023

(30) Foreign Application Priority Data

Oct. 27, 2021 (JP) ..... 2021-175713

(51) Int. Cl.

*B65H 29/24* (2006.01)
*B65H 29/04* (2006.01)
*B65H 31/26* (2006.01)
*B65H 43/00* (2006.01)

(52) U.S. Cl.

CPC ..... *B65H 29/041* (2013.01); *B65H 31/26* (2013.01); *B65H 43/00* (2013.01); *B65H 2301/4212* (2013.01); *B65H 2404/231* (2013.01); *B65H 2511/10* (2013.01); *B65H 2801/03* (2013.01)

(58) Field of Classification Search

CPC ..... B65H 31/16; B65H 31/26; B65H 29/24; B65H 29/241; B65H 29/245; B65H 29/246; B65H 29/247; B65H 29/28; B65H 2406/3662; B65H 2406/366; B65H 2406/121; B65H 2406/1211; B65H 29/041; B65H 29/042

See application file for complete search history.

(56) References Cited

U.S. PATENT DOCUMENTS 5,008,716 A * 4/1991 Onose ..... G03G 15/6552 270/39.05
6,394,448 B2 * 5/2002 Suzuki ..... B65H 29/02 271/189
2020/0130978 A1 4/2020 Tamura
2020/0299093 A1 9/2020 Tamura
2021/0395033 A1 12/2021 Kazama (Continued)

FOREIGN PATENT DOCUMENTS

DE 102017115174 A1 * 1/2019
JP 4-089763 3/1992
JP 08337348 A * 12/1996

(Continued)

*Primary Examiner* — Luis A Gonzalez
(74) *Attorney, Agent, or Firm* — IPUSA, PLLC

(57) ABSTRACT

A sheet stacker includes a tray to store a stack of sheets, a conveyor above the tray, a leading end guide above the tray, and an air exhaust. The conveyor conveys a sheet in a conveyance direction. The leading end guide is downstream from the conveyor in the conveyance direction. The leading end guide guides the sheet from the conveyor to the tray. The air exhaust exhausts air above an upper surface of the stack of sheets on the tray to an upstream from the tray in the conveyance direction. Further, the leading end guide holds a leading end of the sheet conveyed by the conveyor at a holding position and releases the leading end of the sheet at a release position downstream from the holding position in the conveyance direction.

8 Claims, 8 Drawing Sheets

(56) References Cited

U.S. PATENT DOCUMENTS

2022/0177255 A1 6/2022 Kazama

FOREIGN PATENT DOCUMENTS

| | | | | | |
|---|---|---|---|---|---|
| JP | 2002-254858 | | | 9/2002 | |
| JP | 2009078873 | A | * | 4/2009 | |
| JP | 2011042462 | A | * | 3/2011 | ..... B65H 31/02 |
| JP | 2015212194 | A | * | 11/2015 | |
| JP | 2018-141837 | | | 9/2018 | |
| JP | 2019-182655 | | | 10/2019 | |
| JP | 2020-158305 | | | 10/2020 | |
| JP | 2020196560 | A | * | 12/2020 | |

* cited by examiner

SHEET STACKER AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2021-175713, filed on Oct. 27, 2021, in the Japan Patent Office, the entire disclosure of which is hereby incorporated by reference herein.

BACKGROUND

Technical Field

Embodiments of the present disclosure relate to a sheet stacker and an image forming apparatus incorporating the sheet stacker.

Related Art

An image forming apparatus includes a conveyor that conveys a sheet, an image forming unit that forms an image on the sheet conveyed by the conveyor, and a tray to stack the sheets on which the image is formed by the image forming unit.

SUMMARY

Embodiments of the present disclosure describe an improved sheet stacker that includes a tray to store a stack of sheets, a conveyor above the tray, a leading end guide above the tray, and an air exhaust. The conveyor conveys a sheet in a conveyance direction. The leading end guide is downstream from the conveyor in the conveyance direction. The leading end guide guides the sheet from the conveyor to the tray. The air exhaust exhausts air above an upper surface of the stack of sheets on the tray to an upstream from the tray in the conveyance direction. Further, the leading end guide holds a leading end of the sheet conveyed by the conveyor at a holding position and releases the leading end of the sheet at a release position downstream from the holding position in the conveyance direction.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
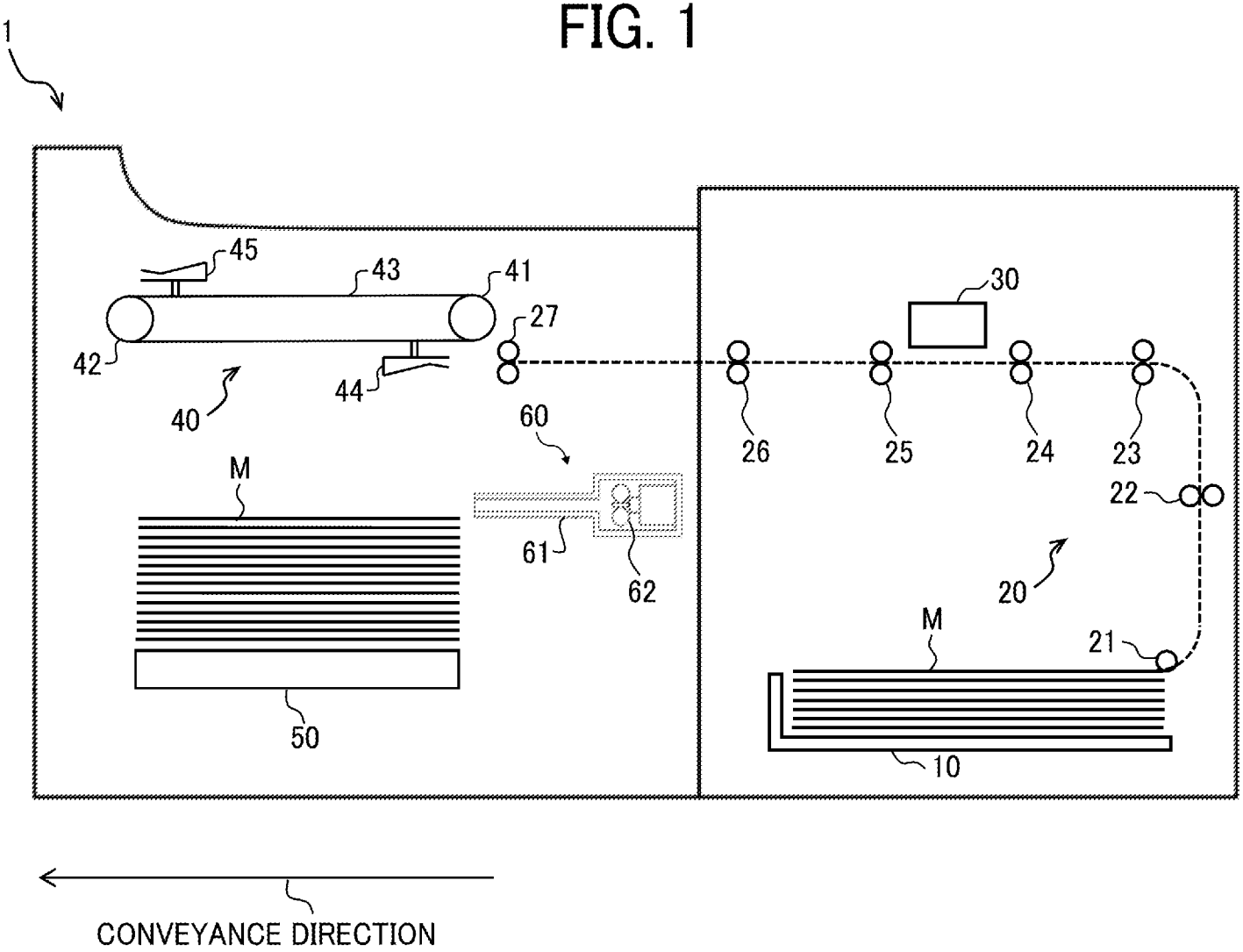
FIG. 1 is a schematic view illustrating an interior of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, with reference to the drawings, a description is given of an image forming apparatus 1 according to an embodiment of the present disclosure. FIG. 1 is a schematic view illustrating an interior of the image forming apparatus 1. The image forming apparatus 1 successively forms images on multiple sheets M. Examples of the sheet M as a sheet-shaped medium include paper (paper sheet), an overhead projector (OHP) transparency, thread, fiber, fabric, leather, metal, and plastic. As illustrated in FIG. 1, the image forming apparatus 1 includes a sheet feed tray 10, a conveyor 20, an image forming unit 30, a leading end guide 40, a sheet ejection tray 50 (i.e., a tray), and an air exhaust 60.

The sheet feed tray 10 stores a stack of sheets M before images are formed thereon. The conveyor 20 feeds the sheet M stored in the sheet feed tray 10 to a position facing the image forming unit 30, and then ejects the sheet M to the sheet ejection tray 50. The conveyor 20 includes a sheet feed roller 21 and a plurality of roller pairs 22, 23, 24, 25, 26, and 27.

The sheet feed roller 21 rotates while contacting the top sheet M among the stack of sheet M in the sheet feed tray 10 to feed the sheet M to a conveyance path of the sheet M. The plurality of roller pairs 22 to 27 is arranged at predetermined intervals along the conveyance path. The roller pairs 22 to 27 rotate while nipping the sheet M to convey the sheet M. The conveyance path indicated by a broken line in FIG. 1 is a space extending from the sheet feed tray 10 to the sheet ejection tray 50 via the position facing the image forming unit 30.

Some of the roller pairs 22 to 27 convey the sheet M in different conveyance directions from others. The roller pair 27 is closest to the sheet ejection tray 50 among the roller pairs 22 to 27. The conveyance direction of the sheet M by the roller pair 27 is a horizontal direction (i.e., from right to left in FIG. 1). The "conveyance direction" simply cited in the present disclosure refers to the conveyance direction by the roller pair 27.

The image forming unit 30 employs an inkjet method in which ink is discharged onto the sheet M to form an image on the sheet M. The image forming unit 30 includes multiple head modules that discharge inks of respective colors of cyan, magenta, yellow, and black. Each of the multiple head modules discharges the ink at a predetermined timing to form an image on the sheet M facing the image forming unit 30. Alternatively, the image forming unit 30 may employ an electrophotographic method in which toner is fixed on the sheet M to form an image on the sheet M.

Among the components of the image forming apparatus 1 illustrated in FIG. 1, the roller pair 27 (a part of the conveyor), the leading end guide 40, the sheet ejection tray 50, and the air exhaust 60 construct a sheet stacker that stacks multiple sheets M, for example.

The leading end guide 40 is disposed downstream from the roller pair 27 in the conveyance direction. The roller pair 27 and the leading end guide 40 are disposed above the sheet ejection tray 50. The leading end guide 40 guides a leading end of the sheet M from the roller pair 27 to a downstream from the sheet ejection tray 50 in the conveyance direction, thereby facilitating the sheet M freely falling toward the sheet ejection tray 50 without conveyance failure of the sheet M such as collision between sheets M, a gap between the sheets M on the sheet ejection tray 50, and a crease or a curl of the sheet M.

Figure 2:
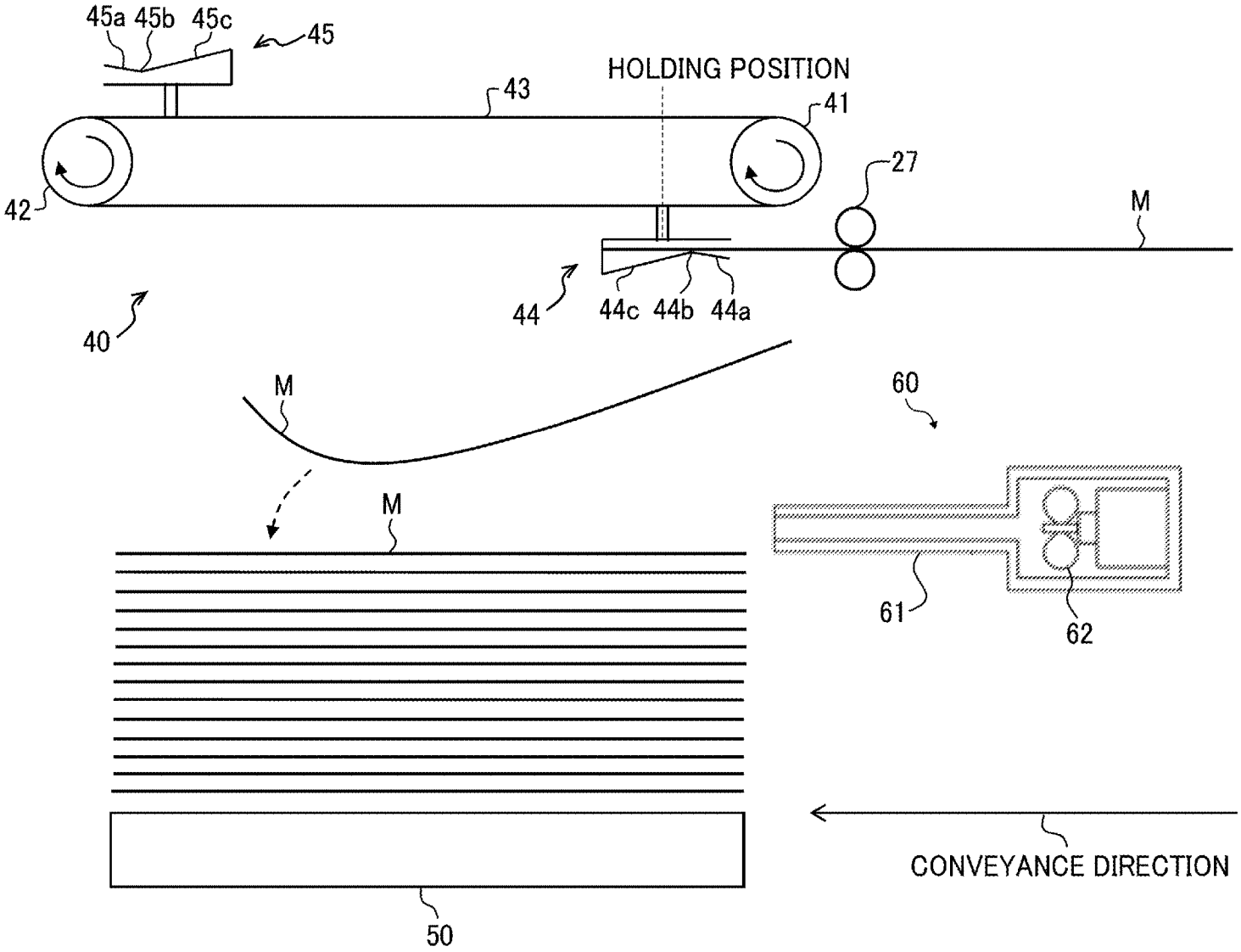
FIG. 2 is a schematic view of a sheet stacker of the image forming apparatus in FIG. 1, in which a guide is at a holding position.
Figure 3:
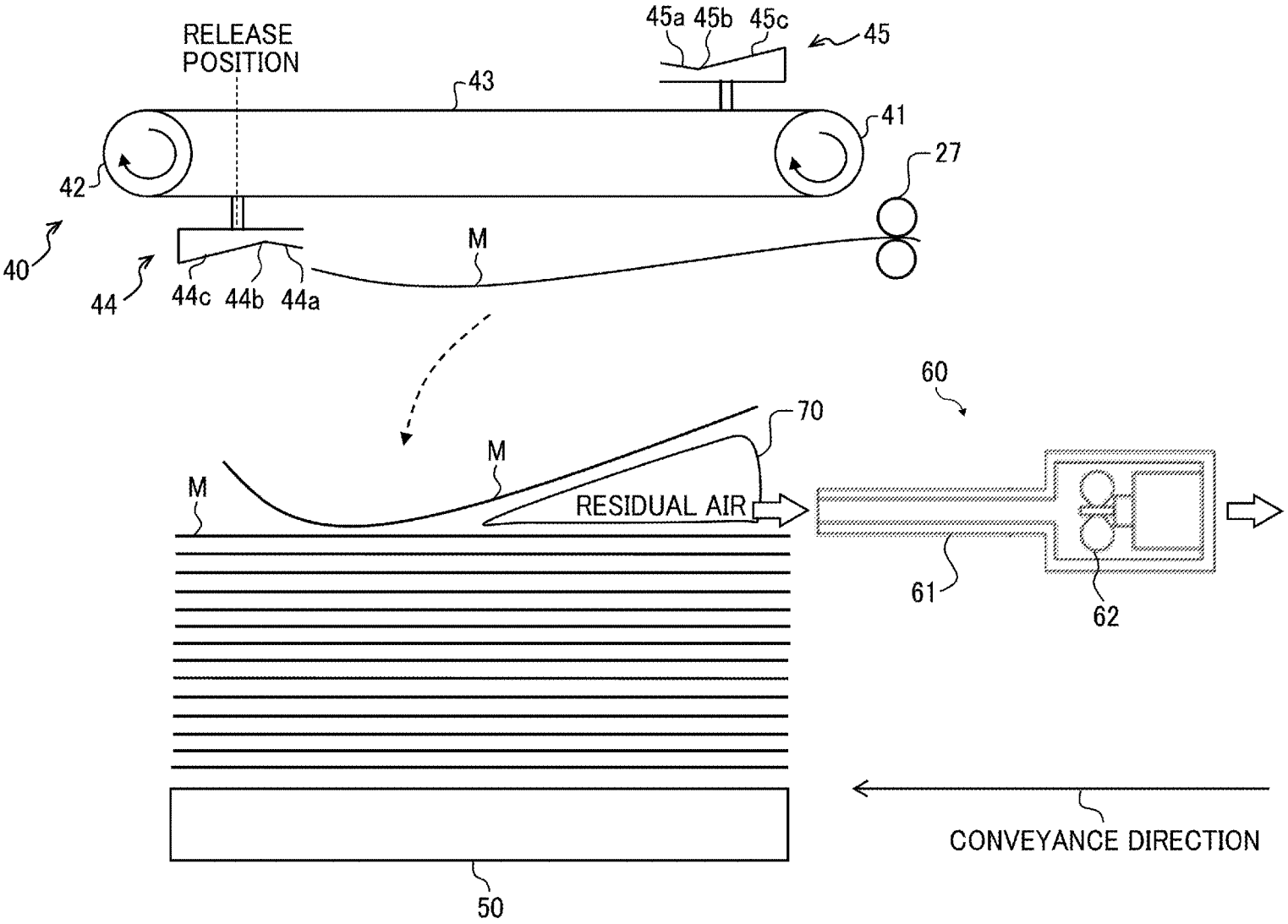
FIG. 3 is a schematic view of the sheet stacker in which the guide is at a release position.

FIG. 2 is a schematic view of the sheet stacker of the image forming apparatus 1, in which a guide 44 is at a holding position. FIG. 3 is a schematic view of the sheet stacker, in which the guide 44 is at a release position. As illustrated in FIGS. 1 to 3, the leading end guide 40 includes a drive roller 41, a driven roller 42, an endless annular belt 43, and multiple guides 44 and 45.

The drive roller 41 and the driven roller 42 are rotatably supported by a housing of the image forming apparatus 1 at positions separated from each other in the conveyance direction. The endless annular belt 43 is stretched over the drive roller 41 and the driven roller 42. As a motor transmits a driving force to the drive roller 41, the drive roller 41 rotates, and the endless annular belt 43 rotates between the drive roller 41 and the driven roller 42. The endless annular belt 43 rotates clockwise in FIGS. 2 and 3. In other words, the endless annular belt 43 rotates in a direction in which a lower stretched portion thereof moves in the conveyance direction and an upper stretched portion thereof moves in the direction opposite to the conveyance direction.

The guides 44 and 45 are attached to the outer circumferential surface of the endless annular belt 43 at equal intervals. Accordingly, as the endless annular belt 43 rotates, the guides 44 and 45 move in the conveyance direction on the lower stretched portion of the endless annular belt 43, and move in the direction opposite to the conveyance direction on the upper stretched portion of the endless annular belt 43. The number of the guides 44 and 45 is not limited to two.

The guide 44 has an internal space for holding the leading end (downstream end in the conveyance direction) of the sheet M. More specifically, the guide 44 includes an opening portion 44*a*, a middle portion 44*b*, and a deep portion 44*c*. Similarly to the guide 44, the guide 45 includes an opening portion 45*a*, a middle portion 45*b*, and a deep portion 45*c*. The structure of the guide 44 is described below.

When the guide 44 is positioned on the lower stretched portion of the endless annular belt 43, the opening portion 44*a* is open toward the upstream side in the conveyance direction (that is, the opening portion 44*a* faces the roller pair 27). When the guide 44 is positioned on the lower stretched portion of the endless annular belt 43, the middle portion 44*b* is positioned downstream from the opening portion 44*a* in the conveyance direction. The middle portion 44*b* has a narrower gap than the opening portion 44*a* and the deep portion 44*c* in the vertical direction. When the guide 44 is positioned on the lower stretched portion of the endless annular belt 43, the deep portion 44*c* is positioned downstream from the middle portion 44*b* in the conveyance direction. When the sheet M is inserted into the guide 44 through the opening portion 44*a*, the leading end of the sheet M contacts the deep portion 44*c*.

The gaps in the vertical direction of the opening portion 44*a*, the middle portion 44*b*, and the deep portion 44*c* are set to be larger than a thickness of the sheet M conveyed by the roller pair 27. That is, the guide 44 holds the sheet M without nipping the sheet M between the upper wall and the lower wall thereof so that the sheet M is not hindered from moving forward and backward. Accordingly, the guide 44 does not scratch the sheet M entering or leaving from the guide 44. The gap in the vertical direction of the middle portion 44*b* is not limited to be narrower than the gaps of the opening portion 44*a* and the deep portion 44*c*. Alternatively, the opening portion 44*a*, the middle portion 44*b*, and the deep portion 44*c* may have the same gap in the vertical direction, or the deep portion 44*c* may have a narrower gap than the middle portion 44*b* in the vertical direction.

When the guide 44 is positioned on the lower stretched portion of the endless annular belt 43, the upper surface of the lower wall of the opening portion 44*a* is inclined upward toward the middle portion 44*b*. A surface of the opening portion 44*a* where the sheet M contacts is smooth without protrusions. Accordingly, a friction when the sheet M enters the internal space of the guide 44 can be reduced. When the portion of the guide 44 where the sheet M contacts is made of a material having high smoothness such as metal or resin, the sheet M can enter the guide 44 more smoothly.

At the start, the guide 44 is stopped at the holding position illustrated in FIG. 2. The opening portion 44*a* on the lower stretched portion of the endless annular belt 43 faces the roller pair 27 at the holding position. In other words, the guide 44 at the holding position can hold the leading end of the sheet M passing through the roller pair 27. That is, the leading end of the sheet M conveyed by the roller pair 27 enters the internal space of the guide 44 through the opening portion 44*a* and reaches the deep portion 44*c*.

When the leading end of the sheet M enters the internal space of the guide 44, the endless annular belt 43 starts rotating, and stops again when the guide 45 reaches the holding position. At that time, the speed (maximum speed) of the guide 44 moving to the downstream side in the conveyance direction is set to be faster than the conveyance speed of the sheet M by the roller pair 27. Therefore, the leading end of the sheet M held by the guide 44 leaves from the guide 44 at a release position illustrated in FIG. 3 due to the speed difference between the conveyance speed of the sheet M by the roller pair 27 and the moving speed of the guide 44.

The release position is downstream from the holding position in the conveyance direction on the lower stretched portion of the endless annular belt 43. When the leading end of the sheet M leaves from the guide 44, a trailing end (upstream end in the conveyance direction) of the sheet M is still nipped by the roller pair 27. That is, the leading end guide 40 releases the leading end of the sheet M before the trailing end of the sheet M passes through the roller pair 27. In other words, the trailing end of the sheet M passes through the roller pair 27 after the leading end of the sheet M is separated from the leading end guide 40.

Thus, the sheet M freely falls toward the sheet ejection tray 50. More specifically, the leading end of the sheet M starts freely falling at the release position, and then the trailing end of the sheet M that has passed through the roller pair 27 starts freely falling. That is, the guide 44 or 45 of the leading end guide 40 holds the leading end of the sheet M conveyed by the roller pair 27 at the holding position and releases the leading end of the sheet M at the release position to guide the sheet M to the sheet ejection tray 50. The endless annular belt 43 rotates intermittently to eject each of the multiple sheets M to the sheet ejection tray 50.

The endless annular belt 43 may start rotating when the leading end of the sheet M contacts the deep portion 44*c* of the guide 44, or may start rotating immediately before the leading end of the sheet M contacts the deep portion 44*c* of the guide 44. If the leading end of the sheet M does not contact the deep portion 44*c*, the leading end of the sheet M can be prevented from being bent or creased. The position of the leading end of the sheet M conveyed by the roller pair 27 can be detected by a known position sensor (for example, an optical sensor, a rotary encoder, or a combination thereof).

The sheet ejection tray 50 stores a stack of sheets M on which images have been formed by the image forming unit 30. The sheet ejection tray 50 is disposed downstream from the roller pair 27 in the conveyance direction and below the roller pair 27 and the leading end guide 40. In other words, the sheet M is conveyed by the roller pair 27, the leading end of the sheet M is guided by the leading end guide 40, and then the sheet M freely falls toward the sheet ejection tray 50.

Figure 4:
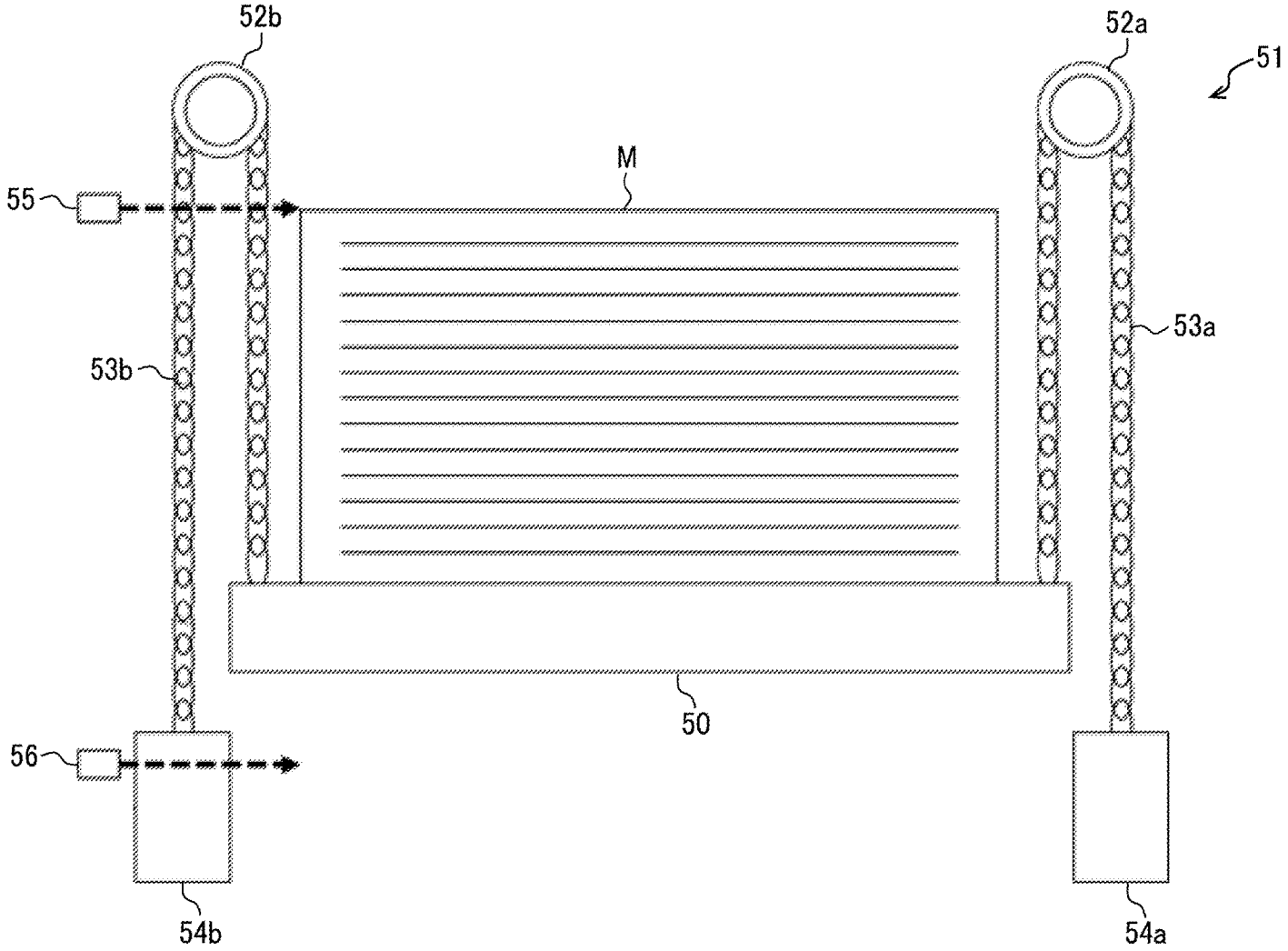
FIG. 4 is a schematic view of an elevator that raises and lowers a sheet ejection tray of the sheet stacker.

FIG. 4 is a schematic view of an elevator 51 that raises and lowers the sheet ejection tray 50. The sheet ejection tray 50 is movable in the vertical direction by the elevator 51. The elevator 51 includes a pair of pulleys 52*a* and 52*b*, a pair of chains 53*a* and 53*b*, a pair of weights 54*a* and 54*b*, an upper surface sensor 55, and a full-state sensor 56. However, the specific configuration of the elevator 51 is not limited to the example illustrated in FIG. 4.

The pair of pulleys 52*a* and 52*b* are rotatably supported by the housing of the image forming apparatus 1 at positions above the sheet ejection tray 50 and separated from each other. The pair of chains 53*a* and 53*b* are stretched over the corresponding pulleys 52*a* and 52*b*. One ends of the pair of chains 53*a* and 53*b* are connected to the sheet ejection tray 50, and the other ends thereof are connected to the corresponding weights 54*a* and 54*b*.

When the pulleys 52*a* and 52*b* rotate in a first direction (in FIG. 4, the pulley 52*a* rotates clockwise and the pulley 52*b* rotates counterclockwise), the sheet ejection tray 50 moves upward and the weights 54*a* and 54*b* move downward. On the other hand, when the pulleys 52*a* and 52*b* rotate in a second direction opposite to the first direction (in FIG. 4, the pulley 52*a* rotates counterclockwise and the pulley 52*b* rotates clockwise), the sheet ejection tray 50 moves downward and the weights 54*a* and 54*b* move upward.

The upper surface sensor 55 detects the position of the top sheet M among the stack of sheets M on the sheet ejection tray 50. The upper surface sensor 55 is disposed above the sheet ejection tray 50, for example, at a position facing a duct 61 (see FIGS. 1 to 3) of the air exhaust 60 or at a position slightly above the duct 61 in the vertical direction. The upper surface sensor 55 is, for example, a reflective optical sensor including a light emitter that outputs light and a light receiver that receives the light output from the light emitter and reflected on the sheet M.

The upper surface sensor 55 outputs a detection signal to a controller 100 (see FIG. 6) described below when the sheet M is in an optical path thereof (that is, when the sheet M stacked on the sheet ejection tray 50 is detected). On the other hand, when the sheet M is not in the optical path, the upper surface sensor 55 stops outputting the detection signal. The upper surface sensor 55 is not limited to the reflective optical sensor, and may be a transmissive optical sensor.

The full-state sensor 56 detects that the sheet ejection tray 50 is full of sheets M. The full-state sensor 56 is disposed, for example, at a position facing the weight 54*b* when the sheet ejection tray 50 is full. The full-state sensor 56 is, for example, a reflective optical sensor including a light emitter that outputs light and a light receiver that receives the light output from the light emitter and reflected on the weight 54*b*.

The full-state sensor 56 outputs a detection signal to the controller 100 when the weight 54*b* is in an optical path thereof (that is, when the sheet ejection tray 50 is full of the sheets M). On the other hand, when the weight 54*b* is not in the optical path, the full-state sensor 56 stops outputting the detection signal. The full-state sensor 56 is not limited to the reflective optical sensor, and may be the transmissive optical sensor.

The air exhaust 60 exhausts a residual air 70 above the upper surface of the top sheet M among the stack of sheet M on the sheet ejection tray 50 to an upstream from the sheet ejection tray 50 in the conveyance direction. More specifically, as illustrated in FIG. 3, the air exhaust 60 exhausts the residual air 70 between the top sheet M stacked on the sheet ejection tray 50 and the sheet M feely falling toward the sheet ejection tray 50, to the upstream from the sheet ejection tray 50 in the conveyance direction.

Figure 5:
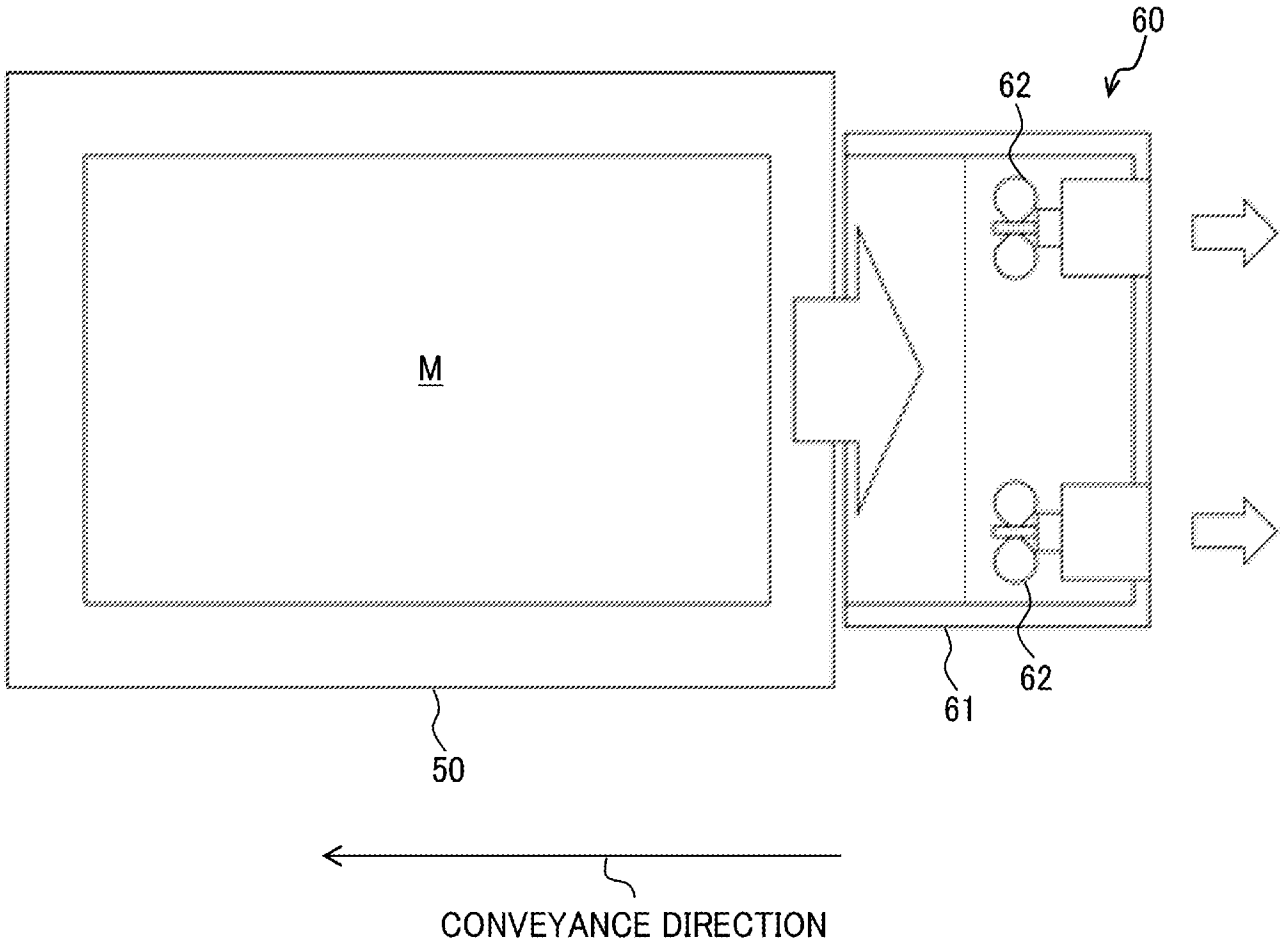
FIG. 5 is a plan view of the sheet ejection tray and an air exhaust of the sheet stacker.

The air exhaust 60 is disposed below the roller pair 27 and the leading end guide 40, and above the sheet ejection tray 50. The air exhaust 60 is disposed upstream from the sheet ejection tray 50 in the conveyance direction. FIG. 5 is a plan view of the sheet ejection tray 50 and the air exhaust 60. The air exhaust 60 is disposed at a position facing the trailing end of the top sheet M stacked on the sheet ejection tray 50 in the vertical direction as illustrated in FIGS. 1 to 3 and in the width direction of the sheets M as illustrated in FIG. 5. The air exhaust 60 includes the duct 61 and a fan 62.

The duct 61 defines an air passage through which the residual air 70 above the upper surface of the top sheets M stacked on the sheet ejection tray 50 is exhausted to the outside of the image forming apparatus 1. The duct 61 is disposed upstream from the sheet ejection tray 50 in the conveyance direction and directed against the upper surface of the top sheet M stacked on the sheet ejection tray 50. Specifically, a leading end of the duct 61 is directed against the upper surface of the top sheet M among the stack of sheets M on the sheet ejection tray 50 on the upstream side of the sheet ejection tray 50 in the conveyance direction. The other end of the duct 61 is open to the outside of the image forming apparatus 1. The leading end of the duct 61, which is directed against the upper surface of the top sheet M stacked on the sheet ejection tray 50, has an opening sufficiently larger than the thickness of the sheets M in the vertical direction and larger than the maximum width of the sheets M in the width direction of the sheet M.

The fan 62 generates an airflow toward the upstream from the sheet ejection tray 50 in the conveyance direction in the duct 61. That is, the air exhaust 60 sucks the residual air 70 above the upper surface of the top sheet M stacked on the sheet ejection tray 50 to the upstream side in the conveyance direction. The fan 62 can change (increase or decrease) at least one of a velocity or an air volume of the generated airflow. A device for generating the airflow (i.e., an air flow generator) toward the upstream from the sheet ejection tray 50 in the conveyance direction is not limited to the fan 62, and a known device such as a blower can be used. That is, examples of the airflow generator include the fan 62 and the blower.

Figure 6:
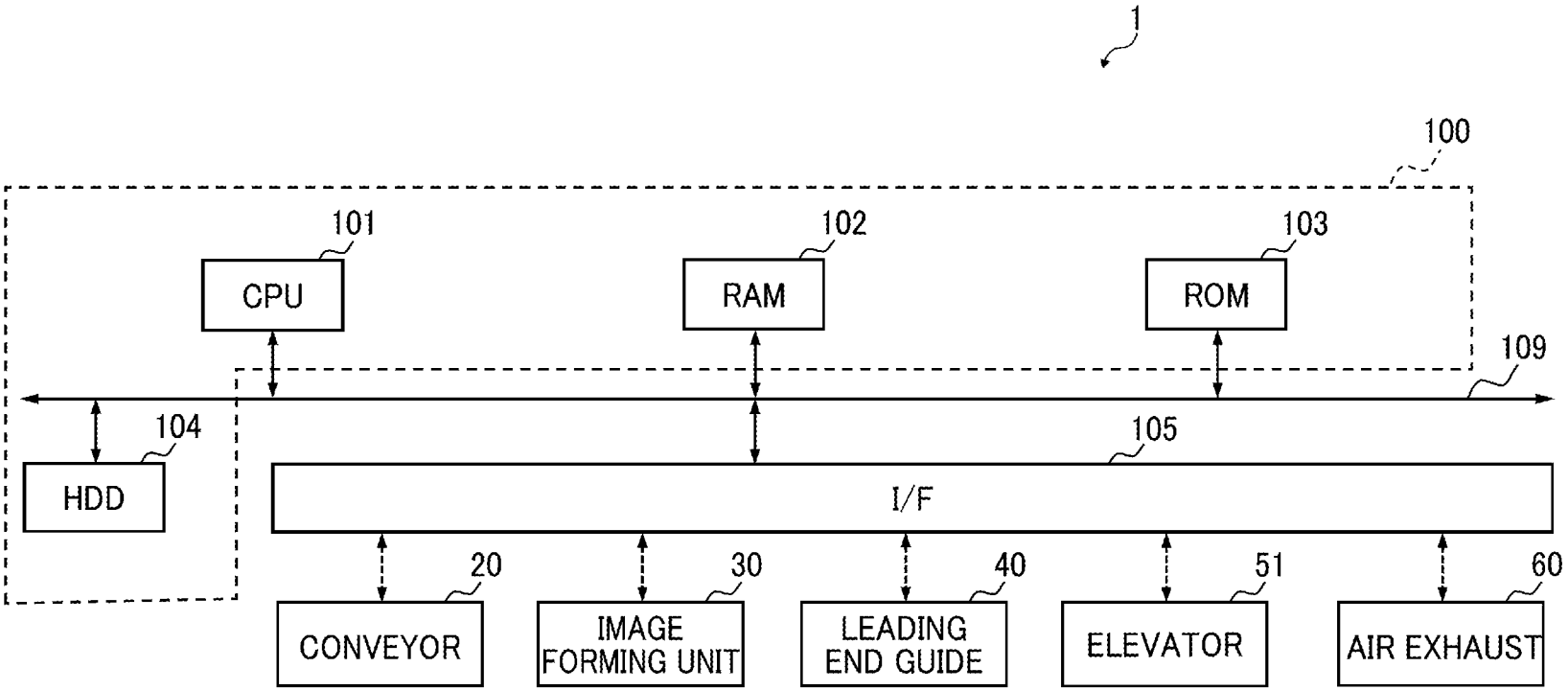
FIG. 6 is a block diagram illustrating a hardware configuration of the image forming apparatus.

FIG. 6 is a block diagram illustrating a hardware configuration of the image forming apparatus 1. The image forming apparatus 1 includes a central processing unit (CPU) 101 as a control device, a random access memory (RAM) 102 as a storage device, a read only memory (ROM) 103 as a storage device, a hard disk drive (HDD) 104 as a storage device, and an interface (I/F) 105, which are connected via a common bus 109 as a communication device. The CPU 101, the RAM 102, the ROM 103, and the HDD 104 are examples of the controller 100 (i.e., circuitry).

The CPU 101 is an arithmetic device and controls the overall operation of the image forming apparatus 1. The RAM 102 is a volatile storage medium that allows data to be read and written at high speed. The CPU 101 uses the RAM 102 as a work area for data processing. The ROM 103 is a non-volatile read only storage medium and stores programs such as firmware. The HDD 104 is a non-volatile storage medium with large storage capacity, in which data is read and written, and stores an operating system (OS), various control programs, application programs, and the like.

In the image forming apparatus 1, the CPU 101 executes a control program stored in the ROM 103, a data-processing program (application program) loaded into the RAM 102 from a recording medium such as the HDD 104, and the like using an arithmetic function.

Such programs executed by the CPU configures a software control unit including various functional modules of the image forming apparatus 1. The software control unit thus configured and the hardware resources installed in the image forming apparatus 1, in combination, construct functional blocks that implement the function of the image forming apparatus 1.

The I/F 105 connects the conveyor 20, the image forming unit 30, the leading end guide 40, the elevator 51, and the air exhaust 60 to the common bus 109. That is, the controller 100 controls the operations of the conveyor 20, the image forming unit 30, the leading end guide 40, the elevator 51, and the air exhaust 60 via the I/F 105.

Figure 7:
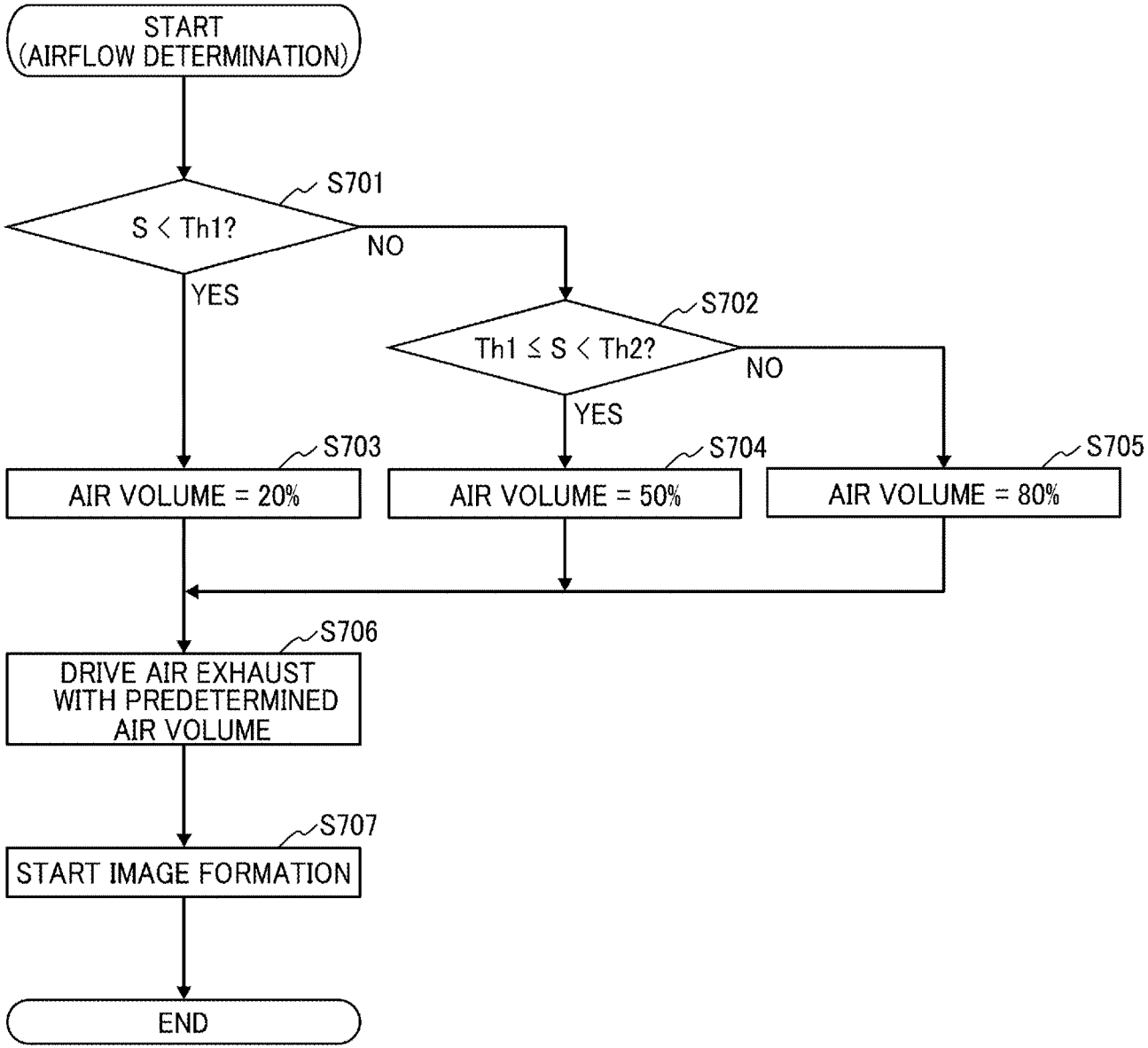
FIG. 7 is a flowchart of an air volume determination process.

FIG. 7 is a flowchart of a process of setting an air volume of the airflow to be generated (i.e., an airflow determination process). In the airflow determination process, the air volume exhausted by the air exhaust 60 (a flow rate of the airflow generated per unit time by the fan 62) is determined. For example, the controller 100 executes the airflow determination process illustrated in FIG. 7 in response to an image forming instruction to successively form images on multiple sheets M.

The image forming instruction includes, for example, image data indicating an image to be formed on the sheet M, the number of sheets M (number of copies) on which the image is to be formed, and a size S of the sheet M on which the image is to be formed (in other words, the size S of the sheet M stacked in the sheet feed tray 10). The size S of the sheet M refers to a size (for example, A4 or B5) of a surface of the sheet M on which an image is recorded. The controller 100 may acquire an image forming instruction from a user via a control panel, or may acquire an image forming instruction from an external device via a communication interface.

First, the controller 100 compares the size S of the sheet M in the image forming instruction with predetermined first and second thresholds Th1 and Th2 (S701 and S702). The second threshold Th2 is larger than the first threshold Th1. The number of thresholds to be compared with the size S is not limited to two in the airflow determination process. The controller 100 increases the air volume of the airflow generated by the air exhaust 60 with increasing the size S of the sheet M (S703 to S705). 5 Values illustrated in steps S703 to S705 indicate the percentage (%) of the air volume when the maximum air volume the fan 62 can generate is defined as 100%. The values in steps S703 to S705 are examples, and the embodiments of the present disclosure are not limited thereto.

More specifically, when the size S of the sheet M is less than the first threshold Th1 (Yes in S701), the controller 100 sets the air volume of the air exhaust 60 to 20% (S703). When the size S of the sheet M is equal to or greater than the first threshold Th1 and less than the second threshold Th2 (No in S701 and Yes in S702), the controller 100 sets the air volume of the air exhaust 60 to 50% (S704). When the size S of the sheet M is equal to or greater than the second threshold Th2 (No in S701 and No in S702), the controller 100 sets the air volume of the air exhaust 60 to 80% (S705).

Then, the controller 100 drives the air exhaust 60 (more specifically, the fan 62) at the air volume determined in steps S703 to S705 (S706). After the driving of the fan 62 is stabilized, the controller 100 starts a process of forming an image on the sheet M in accordance with the image forming instruction (S707). More specifically, the controller 100 causes the conveyor 20 to sequentially convey multiple sheets M, causes the image forming unit 30 to form an image on the sheet M conveyed by the conveyor 20, and operates the leading end guide 40 in synchronization with the arrival of the sheet M conveyed by the roller pair 27.

Figure 8:
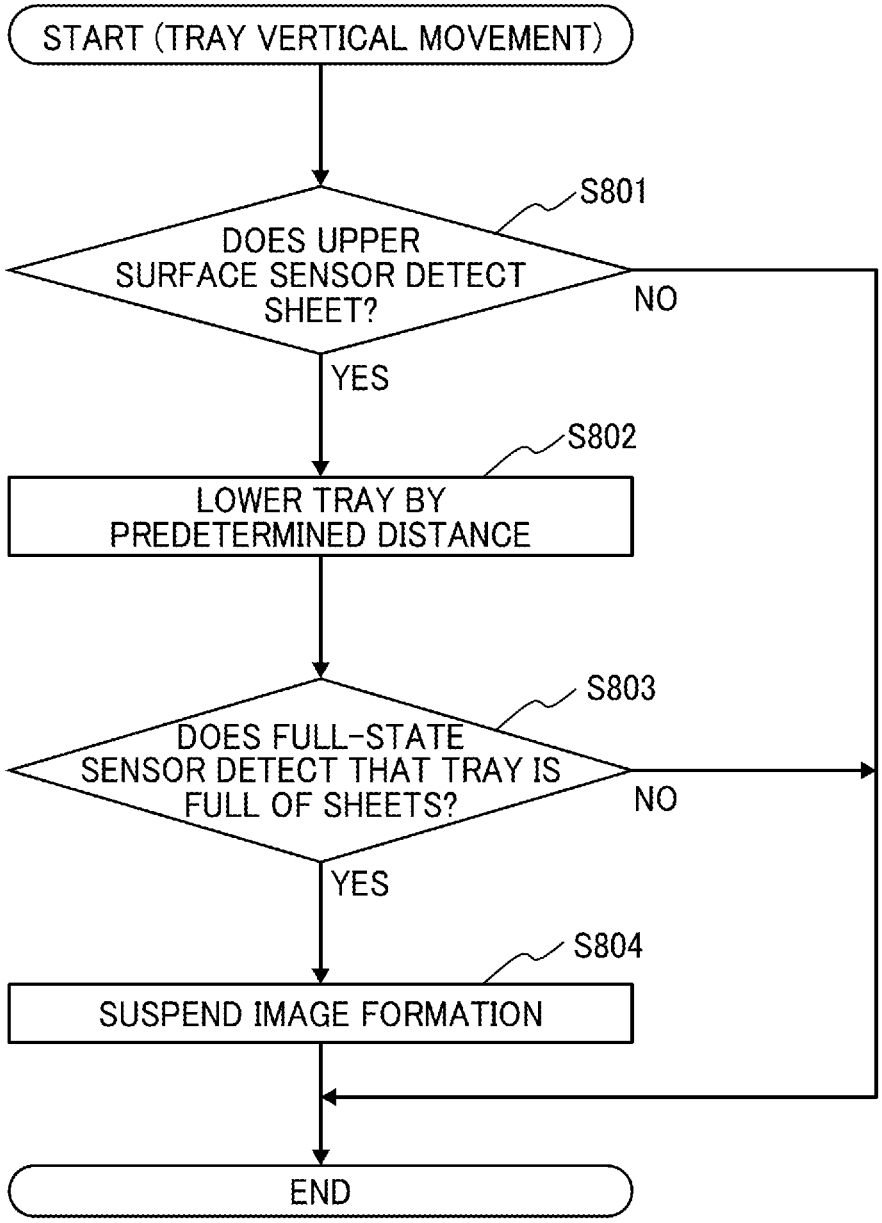
FIG. 8 is a flowchart of tray vertical movement process.

FIG. 8 is a flowchart of a process of moving the sheet ejection tray 50 in the vertical direction (i.e., a tray vertical movement process). In the tray vertical movement process, the elevator 51 moves the sheet ejection tray 50 in the vertical direction so as to move the upper surface of the top sheet M stacked on the sheet ejection tray 50 close to the leading end of the duct 61 while the image forming apparatus 1 successively forms images on multiple sheets M. For example, while the image forming apparatus 1 successively forms images on multiple 5 sheets M, the controller 100 executes the tray vertical movement process each time a predetermined time elapses (or a predetermined number of sheets M are stacked on the sheet ejection tray 50).

First, the controller 100 determines whether the upper surface sensor 55 detects the sheet M (in other words, whether the upper surface sensor 55 outputs a detection signal) (S801). When the controller 100 determines that the upper surface sensor 55 detects the sheet M (Yes in S801), the controller 100 drives the elevator 51 to lower the sheet ejection tray 50 by a predetermined distance (S802).

As a result, the upper surface of the top sheet M stacked on the sheet ejection tray 50 is moved close to the leading end of the duct 61 so that the duct 61 of the air exhaust 60 is directed against the upper surface of the top sheet M stacked on the sheet ejection tray 50. For example, in step S802, the controller 100 may cause the elevator 51 to lower the sheet ejection tray 50 by a predetermined fixed value (e.g., 5 mm) or to lower the sheet ejection tray 50 until the upper surface sensor 55 stops outputting the detection signal.

Then, the controller 100 determines whether the full-state sensor 56 detects that the sheet ejection tray 50 is full (in other words, whether the full-state sensor 56 outputs a detection signal) (S803). When the controller 100 determines that the sheet ejection tray 50 is full (Yes in S803), the controller 100 suspends image formation by the image forming apparatus 1 (S804). That is, the controller 100 stops operations of the conveyor 20, the image forming unit 30, and the leading end guide 40. Further, the controller 100 instructs a user to remove the stack of sheets M on the sheet ejection tray 50 via the control panel.

After the user removes the stack of sheet M from the sheet ejection tray 50, the controller 100 causes the elevator 51 to raise the sheet ejection tray 50 to a start position when the sheet ejection tray 50 is empty and resumes the image formation by the image forming apparatus 1.

On the other hand, when the upper surface sensor 55 does not detect the sheet M (No in S801), the controller 100 ends the tray vertical movement process without executing the processes in step S802 and beyond. When the controller 100 determines that the sheet ejection tray 50 is not full (No in S803), the controller 100 ends the tray vertical movement process without executing the process in step S804. Since the controller 100 repeatedly executes the tray vertical movement process, images are successively formed on multiple sheets M while keeping the duct 61 of the air exhaust 60 being directed against the upper surface of the top sheet M stacked on the sheet ejection tray 50.

According to the above-described embodiment, the following operational effects, for example, are achieved.

According to the above-described embodiment, the air exhaust 60 can remove the residual air 70 between the top sheet M stacked on the sheet ejection tray 50 and the sheet M freely falling toward the sheet ejection tray 50 to reduce an air resistance of the free fall of the sheet M. As a result, even if the conveyance speed of the sheet M by the roller pair 27 is increased (in other words, the interval between the sheets M passing through the roller pair 27 is shortened), the sheets M successively conveyed is prevented from colliding with each other. That is, a throughput of the image forming apparatus 1 is improved.

The leading end guide 40 according to the above-described embodiment does not nip the leading end of the sheet M. In the above-described embodiment, the leading end of the sheet M is released by the guides 44 and 45 before the trailing end of the sheet M passes through the roller pair 27. As a result, as illustrated in FIG. 2, when the sheet M freely falls, the trailing end of the sheet M is positioned higher than the leading end of the sheet M. Therefore, the air exhaust 60 according to the above-described embodiment exhausts the residual air 70 to the upstream from the sheet ejection tray 50 in the conveyance direction to increase a velocity of the trailing end of the sheet M freely falling.

According to the above-described embodiment, the controller 100 executes the tray vertical movement process to causes the sheet ejection tray 50 to move in the vertical direction so that the upper surface of the top sheet M stacked on the sheet ejection tray 50 is moved close to the leading end of the duct 61. Accordingly, when images are successively formed on multiple sheets M, a relative position between the air exhaust 60 and the sheet ejection tray 50 can be appropriately adjusted to exhaust the residual air 70 at an appropriate position. In the above-described embodiment, the sheet ejection tray 50 is moved up and down, but the air exhaust 60 may be moved up and down in another embodiment. That is, the air exhaust 60 may be movable in the vertical direction so that the leading end of the duct 61 is moved close to the upper surface of the top sheet M stacked on the sheet ejection tray 50.

Further, according to the above-described embodiment, since the air volume is adjusted in response to the size S of the sheet M, the velocity of the sheet M freely falling can be appropriately controlled. Note that the controller 100 may adjust the wind speed of the airflow instead of the air volume, or may adjust both the air volume and the wind speed (i.e., the flow rate of the airflow generated by the fan 62). That is, the controller 100 increases the flow rate of the airflow generated by the fan 62 with increasing the size of the sheet M conveyed by the roller pair 27. In the present disclosure, the term "flow rate" includes the velocity and the air volume of the airflow generated by the fan 62

Note that the present disclosure is not limited to specific embodiments described above, and numerous additional modifications and variations are possible in light of the teachings within the technical scope of the appended claims. It is therefore to be understood that the disclosure of this patent specification may be practiced otherwise by those skilled in the art than as specifically described herein, and such, modifications, alternatives are within the technical scope of the appended claims. Such modifications are also included in the technical scope of the present disclosure.

Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet stacker comprising:

a tray configured to store a stack of sheets;

a conveyor above the tray, the conveyor configured to convey a sheet in a conveyance direction;

a leading end guide above the tray and downstream from the conveyor in the conveyance direction, the leading end guide configured to guide the sheet from the conveyor to the tray; and an air exhaust configured to exhaust air above an upper surface of the stack of sheets on the tray to an upstream from the tray in the conveyance direction, wherein the leading end guide is configured to:

hold a leading end of the sheet conveyed by the conveyor at a holding position; and release the leading end of the sheet at a release position downstream from the holding position in the conveyance direction, and wherein the air exhaust has an opening opened toward the upper surface of the stack of sheets, the opening being larger than a thickness of the sheet in a vertical direction and larger than a maximum width of the sheet in a width direction of the sheet, the width direction of the sheet being perpendicular to the conveyance direction.

2. The sheet stacker according to claim 1, wherein the air exhaust includes:

a duct upstream from the tray in the conveyance direction, a leading end of the duct being directed against the upper surface of the stack of sheets on the tray; and an airflow generator configured to generate an airflow, in the duct, toward the upstream from the tray in the conveyance direction.

3. The sheet stacker according to claim 2, wherein the tray is configured to move in the vertical direction such that the leading end of the duct is directed toward the upper surface of the stack of sheets on the tray.

4. The sheet stacker according to claim 2, further comprising circuitry configured to cause the airflow generator of the air exhaust to change a flow rate of the airflow in the duct.

5. The sheet stacker according to claim 4, wherein the circuitry is configured to cause the airflow generator of the air exhaust to increase the flow rate of the airflow in the duct according to an increase in a size of the sheet conveyed by the conveyor.

6. The sheet stacker according to claim 2, further comprising an elevator configured to move the tray in the vertical direction to move the upper surface of the stack of sheets on the tray to face the leading end of the duct.

7. An image forming apparatus comprising:

an image forming unit configured to form an image on a sheet; and the sheet stacker according to claim 1, to stack the sheet on which the image is formed by the image forming unit on the tray.

8. The sheet stacker according to claim 2, wherein the opening is disposed at the leading end of the duct.

* * * * *